US005786656A

United States Patent [19]

Hasegawa et al.

[11] Patent Number: 5,786,656

[45] Date of Patent: Jul. 28, 1998

[54] FIELD-EMISSION COLD-CATHODE DEVICE AND METHOD OF FABRICATING THE SAME

[75] Inventors: Toshimichi Hasegawa, Tokyo; Masayuki Nakamoto, Chigasaki, both of Japan

[73] Assignee: Kabushiki Kaisha Toshiba, Kawasaki, Japan

[21] Appl. No.: 708,731

[22] Filed: Sep. 5, 1996

[30] Foreign Application Priority Data

Sep. 7, 1995 [JP] Japan ..... 7-230346

[51] Int. Cl.[6] ..... H01J 1/46

[52] U.S. Cl. ..... 313/308; 313/309; 313/336; 313/351

[58] Field of Search ..... 313/308, 309, 313/336, 351

[56] References Cited

U.S. PATENT DOCUMENTS 4,663,559 5/1987 Christensen ..... 313/336 X 5,483,118 1/1996 Nakamoto et al. ..... 313/309

5,499,938 3/1996 Nakamoto et al. ..... 445/50

5,627,427 5/1997 Das et al. ..... 313/336 X

FOREIGN PATENT DOCUMENTS 6 12974 1/1994 Japan .

OTHER PUBLICATIONS

Extended Abstracts, 21p–ZQ–5, The Japan Society of Applied Physics (The 55th Autumn Meeting), M. Mori, et al., "Beam Focusing of Field Emitter Array", Dec. 1995.

IVMC 1994, pp. 134–139, W. Dawson Kesling, et al., "Beam Focusing for Field Emission Flat Panel Displays", Dec. 1994.

*Primary Examiner*—Ashok Patel

*Attorney, Agent, or Firm*—Oblon, Spivak, McClelland, Maier & Neustadt, P.C.

[57] ABSTRACT

A field-emission cold-cathode device including a substrate, an emitter having a sharp distal, a gate electrode having a hole in a region of the distal end of the emitter, and a focusing electrode formed farther from the distal end of the emitter than the gate electrode in a region of an end portion near the emitter.

22 Claims, 7 Drawing Sheets

FIELD-EMISSION COLD-CATHODE DEVICE AND METHOD OF FABRICATING THE SAME

BACKGROUND OF THE INVENTION

1. Field of the Invention

The present invention relates to a field-emission cold-cathode device such as a flat display, an electron beam device, a very high-speed device, and an environment-resistant device.

The present invention also relates to a method of fabricating the field-emission cold-cathode device.

2. Description of the Related Art

Recently, field-emission cold-cathode devices are extensively developed by using the advanced Si semiconductor processing technologies and applied to, e.g., very high-speed microwave devices, electron beam devices, and flat displays.

FIGS. 1 to 6 show an example of a fabrication process of a conventional field-emission cold-cathode device.

In this process, as shown in FIG. 1, an n-type Si substrate 1 is first wet-etched to form an oxide film 11 on its surface. In FIG. 2, the oxide film 11 is processed by photolithography to form a mask 111. In FIG. 3, the Si substrate 1 is etched by RIE (Reactive Ion Etching) to roughly form an Si emitter. In FIG. 4, the distal end of the Si emitter is sharpened by thermal oxidation. In FIG. 5, an insulating film 5 such as an $SiO_2$ film and a gate electrode layer (drawing electrode layer) 3 made from, e.g., Au, are successively formed on the Si substrate 1. In addition, an insulating film 7 similar to the insulating film 5 and a focusing electrode layer 4 made from, e.g., Au, are successively formed. Finally, the oxide film 6 covering the emitter 2 is etched away to lift off the layers above the emitter 2. In this way, a field-emission cold-cathode device as shown in FIG. 6 is obtained.

In this field-emission cold-cathode device, a positive potential is applied to the drawing electrode 3, and a negative potential is applied to the focusing electrode 4. Consequently, electron beams drawn from the emitter 2 are focused toward its central axis by an electric field formed around the focusing electrode 4. For example, when the field-emission cold-cathode device is used as an electron source of an image display apparatus, high-quality electron beams whose spread is controlled can be obtained. As a result, a high-resolution image display can be obtained.

The conventional field-emission cold-cathode device as described above, however, has the problem that some electron beams are captured by the focusing electrode 4 because the focusing electrode 4 is formed in the electron drawing direction, and this decreases the amount of electrons flowing between the emitter and the anode.

As one method of solving this problem, a field-emission cold-cathode device in which an electrode layer having the same function as the focusing electrode is formed in the same plane as the gate electrode layer is described in "Manuscripts for 1994 Autumn Applied Physics Society Associated Joint Lectures 21p-ZQ-5". In this field-emission cold-cathode device, as illustrated in FIG. 7, an n-type region 22 is formed on a p-type substrate 21, and an insulating layer 23 and an emitter layer 24 are formed on this n-type region 22. A gate electrode 25 for drawing electrons is formed, near the emitter layer 24, on the insulating layer 23. A focusing electrode 26 for focusing the drawn electron beams is formed on the insulating layer 23 outside the-gate electrode 25. In this field-emission cold-cathode device, the gate electrode 25 and the focusing electrode 26 are integrally formed in the same plane. Therefore, unlike the field-emission cold-cathode device shown in FIG. 6, the focusing electrode 26 is not formed in the direction in which electrons are drawn by the gate electrode 25. Consequently, no emission electrons are captured by the focusing electrode 26, and this greatly decreases a reduction in the amount of electrons flowing between the emitter and the anode. Unfortunately, in the field-emission cold-cathode device having the above structure in which the gate electrode and the focusing electrode are formed in the same plane, the effect of controlling the spread of the drawn electron beams is slightly weaker than that of the field-emission cold-cathode device having the structure in which the focusing electrode is formed in the electron drawing direction as shown in FIG. 6. Also, a patterning step is necessary to separately form the gate electrode and the focusing electrode, resulting in a complicated fabrication method. Furthermore, the degree of integration is difficult to increase because the gate electrode and the focusing electrode are formed in the same plane.

SUMMARY OF THE INVENTION

The present invention has been made to solve the above conventional problem, and has as its object to provide a field-emission cold-cathode device which well controls the spread of drawn electron beams and does not complicate the fabrication process, and a method of fabricating the same.

According to the first aspect of the present invention, there is provided a field-emission cold-cathode device comprising a substrate, an emitter formed on the substrate and having a sharp distal end, a gate electrode electrically insulated from the emitter and having a hole in a region of the distal end of the emitter, and a focusing electrode electrically insulated from the gate electrode, formed farther from the distal end of the emitter than the gate electrode, and having an inclined surface in a region of an end portion near the emitter.

A focusing electrode layer having a triangular section can be obtained by forming a second inclined surface opposing the first inclined surface. Also, a focusing electrode layer having a trapezoidal section can be obtained by forming a flat portion between the first and the second inclined surfaces. The first and the second inclined surfaces and the flat portion can be connected or separated from each other.

The focusing electrode layer is preferably made from the same material as the emitter and more preferably formed in the same step as the emitter.

The emitter layer an d the focusing electrode layer can be made from a material selected from the group consisting of molybdenum (Mo), tungsten (W), $LaB_6$, TiN, and niobium (Nb).

The gate electrode layer can be made from a material selected from the group consisting of chromium (Cr), aluminum (Al), Nb, Mo, W, tantalum (Ta), and silicon (Si).

According to the second aspect of the present invention, there is provided a method of fabricating the field-emission cold-cathode device according to the first aspect.

The field-emission cold-cathode device fabrication method according to the second aspect of the present invention comprises the steps of forming an emitter formation recessed portion and a focusing electrode formation trench around the emitter formation recessed portion, said emitter formation recessed portion having a sharp bottom portion in a surface of a first substrate, said focusing electrode formation trench having an inclined surface at least on a side near the emitter formation recessed portion, forming an insulating layer on the surface of the substrate in which the emitter formation recessed portion and the focusing electrode formation trench are formed, forming, on the insulating layer, an emitter layer having a sharp bottom portion along the surface shape of the insulating layer and a focusing electrode layer having an inclined surface on a side near the emitter layer, forming a resistance layer on the emitter layer and the focusing electrode layer, forming a metal layer on the resistance layer, forming a second substrate on the metal layer, removing the first substrate to expose the insulating layer, forming a gate electrode layer on the insulating layer, and removing an unnecessary portion of the insulating layer.

In the field-emission cold-cathode device of the present invention, the focusing electrode for focusing electron beams drawn from the emitter has the inclined surface in the region of the end portion near the emitter. This inclined surface further focuses the electron beams.

Also, in the present invention, the field-emission cold-cathode device described above can be fabricated without adding any special step to a fabrication method of a conventional field-emission cold-cathode device having no focusing electrode. This greatly improves the production efficiency.

In the above method, the emitter and the focusing electrode material layer are formed along the surface shape of the insulating layer, and the resistance layer is formed along the emitter formation recessed portion and the focusing electrode formation trench so as to bury the surfaces of the recessed portion and the trench. However, it is also possible to omit this resistance layer by integrally forming the emitter and the focusing electrode material layer so as to bury the surfaces of the emitter formation recessed portion and the focusing electrode formation trench along the recessed portion and the trench.

The resistance layer can be made from polysilicon (p-si).

The metal layer can be made from a material selected from the group consisting of Ta, Al, Ti, Ni, germanium (Ge), Ga-As, and Kovar.

The insulating layer can be made from a material selected from the group consisting of Al and $S_2N_4$.

Examples of the sectional shape of the trench are a V shape and a trapezoid.

The field-emission cold-cathode device according to the first aspect can be classified into the following three preferred embodiments.

According to the first preferred embodiment of the first aspect, there is provided a field-emission cold-cathode device comprising a substrate, an emitter formed on the substrate and having a sharp distal end, an insulating layer formed on the substrate and having a hole at least above the region of the distal end of the emitter, a gate electrode formed on the insulating layer and having a hole at least above the region of the distal end of the emitter, a peripheral portion of the hole being slightly extended on a side closer to the emitter than an edge of the hole in the insulating layer, and a focusing electrode layer formed around the emitter and the gate electrode so as to be electrically insulated from the gate electrode layer and having an inclined surface in a region of an end portion near the emitter.

According to the second preferred embodiment of the first aspect, there is provided a field-emission cold-cathode device comprising a substrate, an emitter formed on the substrate and having a sharp distal end, a first insulating layer formed on the substrate and having a hole above the emitter, a gate electrode layer formed on the first insulating layer and having a hole above the emitter, a second insulating layer formed on the gate electrode layer and having a hole above the emitter, and a focusing electrode formed on the second insulating layer and having an inclined surface in a region of an end portion near the emitter.

According to the third preferred embodiment of the first aspect, there is provided a field-emission cold-cathode device comprising a substrate, an emitter formed on the substrate and having a sharp distal end, an insulating layer formed on the surface of the substrate and having a hole above the emitter, a gate electrode layer formed near the hole on the insulating layer, and a focusing electrode layer electrically insulated from the gate electrode layer, formed on the insulating layer farther from the distal end of the emitter than the gate electrode layer, and having an inclined surface in a region of an end portion near the emitter.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

The present invention will be described in detail below with reference to the accompanying drawings.

Figure 8:
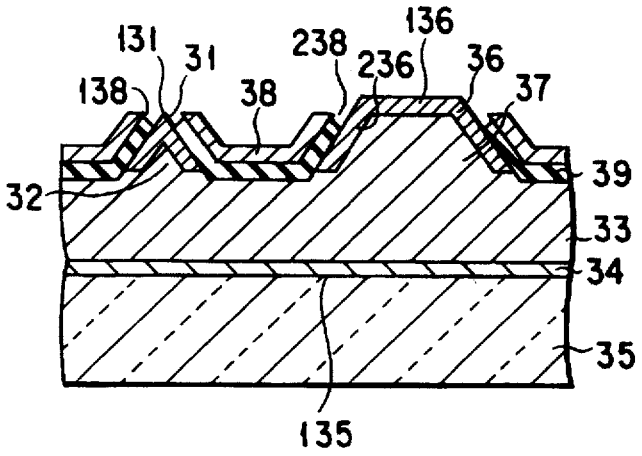
FIG. 8 is a partial schematic sectional view showing the first example of a field-emission cold-cathode device according to the first preferred embodiment of the first aspect of the present invention.
Figure 9:
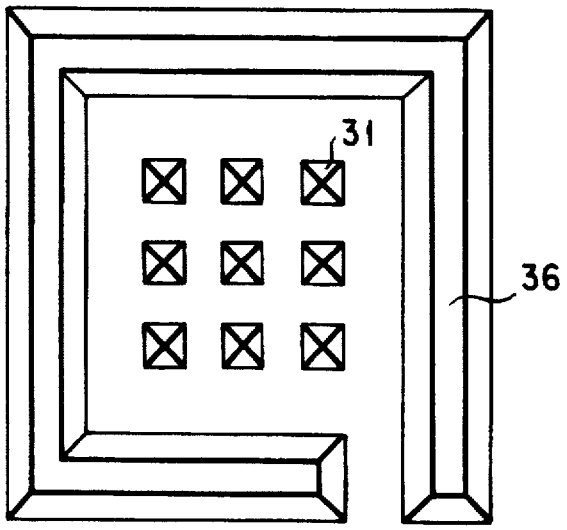
FIG. 9 is a plan view of the field-emission cold-cathode device including the structure shown in FIG. 8.

FIG. 8 is a partial schematic sectional view showing the first example of the field-emission cold-cathode device according to the first preferred embodiment of the first aspect of the present invention. FIG. 9 is a plan view of the field-emission cold-cathode device having the structure shown in FIG. 8.

In this field-emission cold-cathode device, as shown in FIGS. 8 and 9, an emitter 31 having a sharp distal end 131 is formed on a resistance layer 33 connected to a glass substrate 35 via an emitter power supply electrode layer 34. This emitter 31 is made from a metal such as molybdenum (Mo). An internal recessed portion 32 of the emitter 31 is buried with the resistance layer 33.

A focusing electrode 36 is formed on the resistance layer 33 by using, e.g., the same metal (e.g., Mo) as the emitter 31. The focusing electrode 36 consists of a summit 136 substantially parallel to a substrate surface 135 and a side portion 236 inclining and extending from the summit 136 to the substrate 35. Like the emitter 31, a recessed portion 37 on the side of the substrate 35 is buried with the resistance layer 33. As illustrated in FIG. 9, this focusing electrode 36 is so formed as to surround an emitter array consisting of a plurality of emitters 31 or to surround each emitter 31.

A gate electrode 38 is formed along the shape of the emitter so as to form a hole 138 through which the distal end 131 of the emitter protrudes and a hole 238 in a portion corresponding to the summit 136 of the focusing electrode 36.

In addition, an insulating layer 39 such as an $SiO_2$ layer is formed between the gate electrode layer 38 and the emitter layer 31. Like the gate electrode layer 38, this insulating layer 39 is selectively etched away so that the distal end 131 of the emitter layer and the summit 136 of the focusing electrode are exposed.

In the-field-emission cold-cathode device with the above structure, the emitter 31 is applied with a ground potential or a low potential close to the ground potential. The gate electrode 38 is applied with a positive potential at which an electric field capable of drawing electrons from the distal end 131 of the emitter is formed. A potential lower than the potential applied to the gate electrode 38 is applied to the focusing electrode 36. In this example, the same potential as the emitter 31 is applied to the gate electrode 38.

Figure 10:
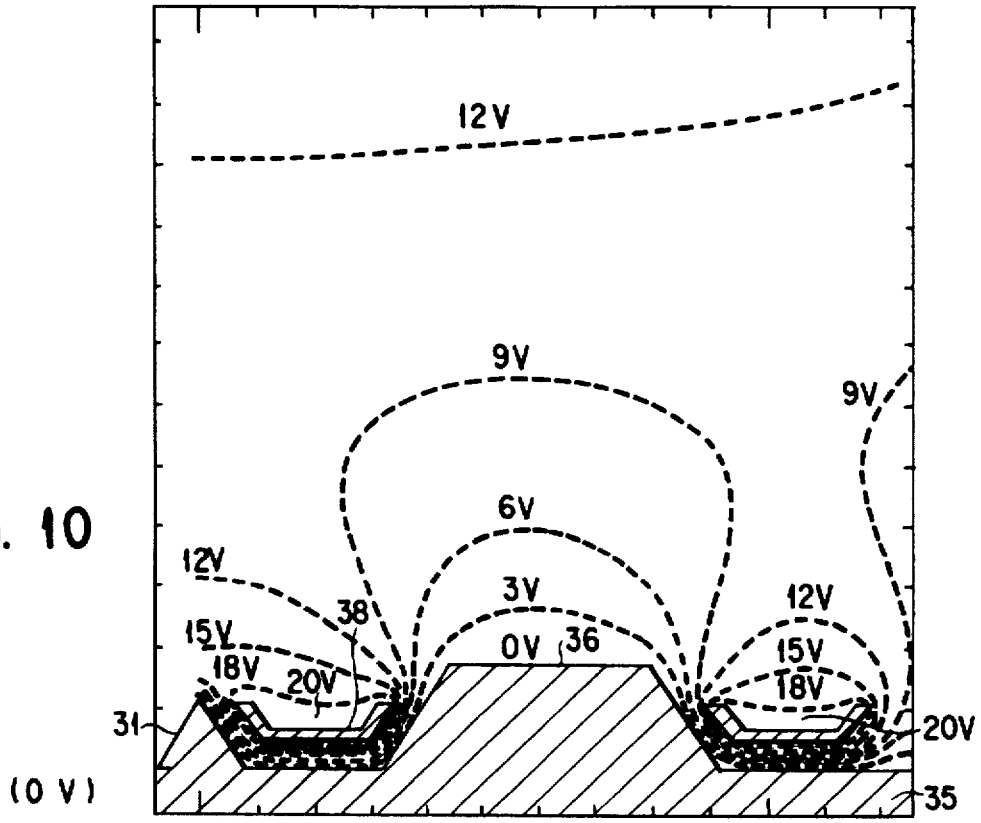
FIG. 10 is a graph showing the potential distribution of the field-emission cold-cathode device shown in FIGS. 8 and 9.

FIG. 10 shows a potential distribution in the field-emission cold-cathode device illustrated in FIGS. 8 and 9. Referring to FIG. 10, the potential of the emitter 31 and the focusing electrode 36 is 0V, and the potential of the gate electrode 38 is 20V. To capture electrons drawn from the emitter 31, an anode electrode is formed in a position 30 μm apart from the bottom of the emitter. The broken curves in FIG. 10 indicate equipotential lines formed in the device. If this field-emission cold-cathode device, the equipotential lines largely project toward the emitter 31 in a portion above the focusing electrode 36. Therefore, electron beams drawn from the emitter 31 are focused toward the central axis of the emitter. As a consequence, high-quality electron beams whose spread is controlled can be obtained.

Figure 1:
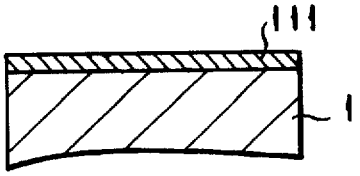
FIG. 1 (PRIOR ART)
FIGS. 1 to 6 are sectional views showing one example of a fabrication process of a conventional field-emission cold-cathode device.
Figure 2:
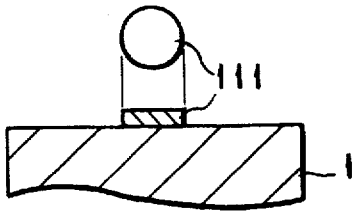
FIG. 2 (PRIOR ART)
Figure 3:
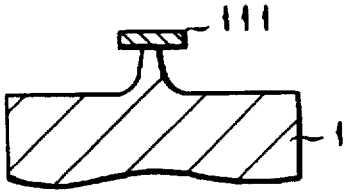
FIG. 3 (PRIOR ART)
Figure 4:
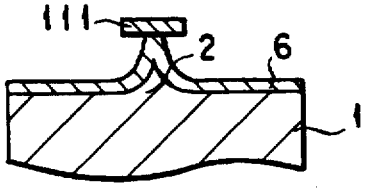
FIG. 4 (PRIOR ART)
Figure 5:
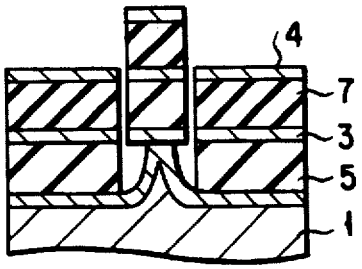
FIG. 5 (PRIOR ART)
Figure 6:
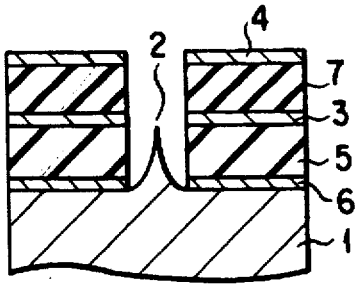
FIG. 6 (PRIOR ART)
Figure 7:
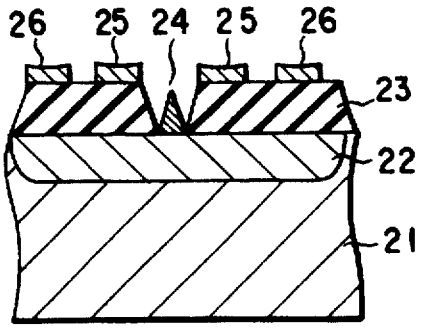
FIG. 7 (PRIOR ART)
FIG. 7 is a schematic sectional view showing another example of a conventional field-emission cold-cathode device.
Figure 11:
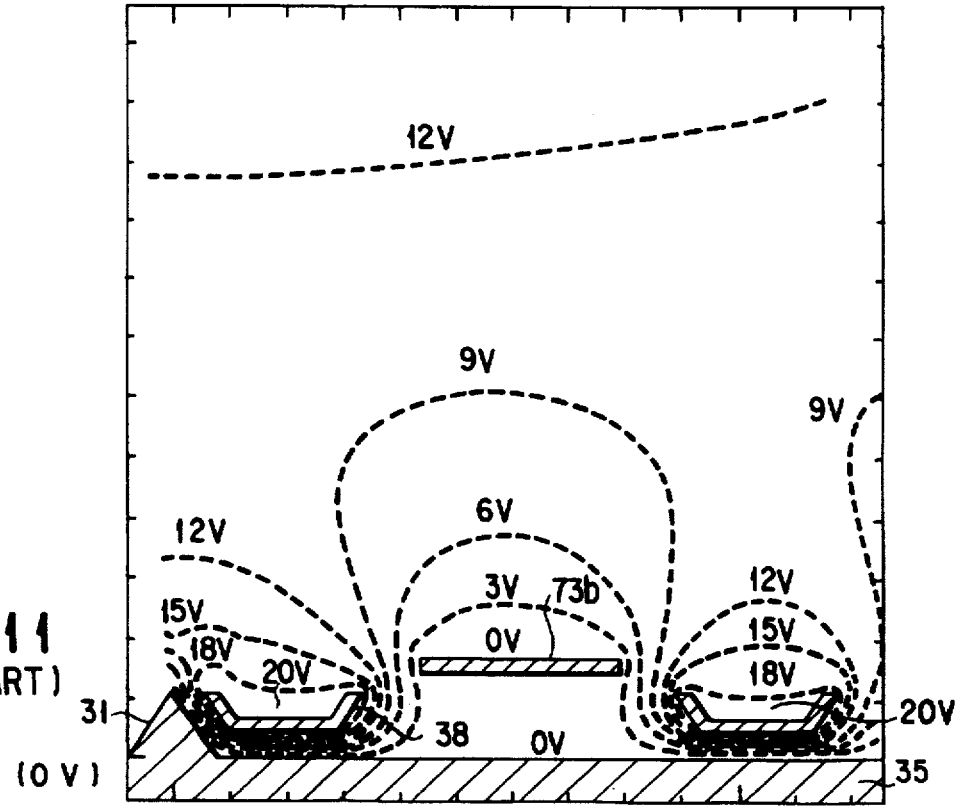
FIG. 11 (PRIOR ART)
FIG. 11 is a graph showing the potential distribution of a conventional field-emission cold-cathode device.

In contrast, when a focusing electrode 736 has no side surface inclined toward the substrate 35, i.e., in a structure having this focusing electrode 736, e.g., a structure equivalent to a field-emission cold-cathode device similar to the one shown in FIG. 7, a potential distribution is as shown in FIG. 11.

Comparing the two potential distributions shows that the equipotential lines in the field-emission cold-cathode device of the present invention, as shown in FIG. 10, in which the focusing electrode has the inclined surface, project more largely toward the emitter than the equipotential lines in the conventional field-emission cold-cathode device, as shown in FIG. 11. That is, the equipotential lines are pushed toward the emitter 31 by the inclined surface, and this enhances the effect of focusing the electron beams drawn from the emitter 31.

In this example, the emitter 31 and the focusing electrode 36 or 736 are set at the same potential. However, the emitter 31 and the focusing electrode 36 or 736 can also be set at different potentials.

One example of the field-emission cold-cathode device fabrication method according to the second aspect of the present invention will be described below with reference to FIGS. 12 to 20.

Figure 12:
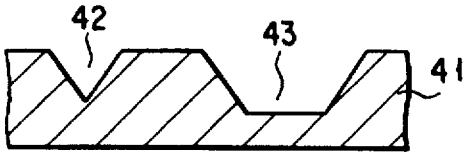
FIGS. 12 to 20 are sectional views for explaining one example of a method of fabricating a field-emission cold-cathode device according to the second aspect of the present invention.

First, a 0.1-μm thick $SiO_2$ thermal oxide film (not shown) is formed by dry oxidation on a p-type Si single-crystal substrate 41 having a (100) crystal orientation. The $SiO_2$ thermal oxide film is coated with a resist (not shown) by spin coating. The resist is then patterned by, e.g., exposure and development by using a stepper, thereby forming one or a plurality of 1-μm side square holes and a 4-μm wide trench surrounding the holes. The $SiO_2$ oxide layer is etched with an $NH_4F.HF$ solution mixture. After the resist is removed, anisotropic etching is performed using an aqueous 30-wt % KOH solution. Consequently, as shown in FIG. 12, a 0.71-μm deep inverted quadrangular pyramid recessed portion (emitter formation recessed portion) 42 and a 1-μm deep trench (focusing electrode formation trench) 43 with a trapezoidal section are formed on the Si substrate 41, whereby a plane surface and an inclined surface can be obtained.

Figure 13:
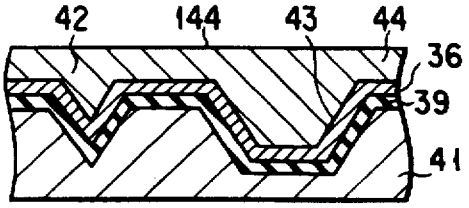

The $SiO_2$ thermal oxide layer is once removed by using an $NH_4F.HF$ solution mixture, and an insulating layer 39, such as an $SiO_2$ thermal oxide insulating layer, is formed on the Si substrate 41 so that the layer 39 is formed along the substrate surface including the recessed portion 42 and the trench 43. More specifically, the insulating layer 39 is formed to have a film thickness of 0.4 μm by, e.g., wet oxidation. A metal material layer 36, such as a W or Mo layer, serving as an emitter layer and a focusing electrode layer, is formed on the insulating layer 39. More specifically, the metal layer 36 is formed to have a thickness of 0.1 μm by sputtering. As shown in FIG. 13, this metal layer 36 is spin-coated with a resist 44 such that the emitter formation recessed portion 42 and the focusing electrode formation trench 43 are well buried with the resist 44 and a surface 144 of the resist 44 is nearly flattened.

Figure 14:
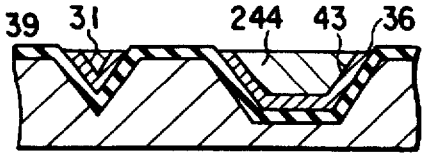

As shown in FIG. 14, the resist 44 is etched back with oxygen plasma, thereby removing the resist 44 and the metal layer 36 except the inclined metal layer 36 and a resist layer 244 in the emitter formation recessed portion 42 and the focusing electrode formation trench 43.

Thereafter, the residual resist 244 is completely removed, and a resistance layer, e.g., an Si layer 33, having a thickness of about 1 μm, is formed by, e.g., sputtering. A surface 133 of this Si layer 33 is polished and flattened. On the flattened surface 133, a metal layer 34 for supplying power to the emitter 31 and connecting the emitter 31 to a glass substrate 35 is formed. The metal layer 34 is formed by using, e.g., Ta.

Figure 15:
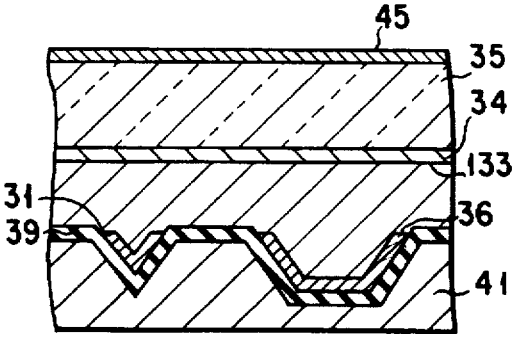

The glass substrate 35 is prepared as a structural substrate serving as a second substrate. The glass substrate 35 is, e.g., a 1-mm thick pyrex glass substrate whose back surface is coated with a 0.3-μm thick Al layer 45. As shown in FIG. 15, this glass substrate 35 and the Si substrate 41 are bonded via the metal layer 34. This bonding is done by using, e.g., an electrostatic bonding method such that while negative and positive voltages are applied to the glass substrate 35 and the Si substrate 41, respectively, these substrates are heated to several hundreds °C. and bonded.

Figure 16:
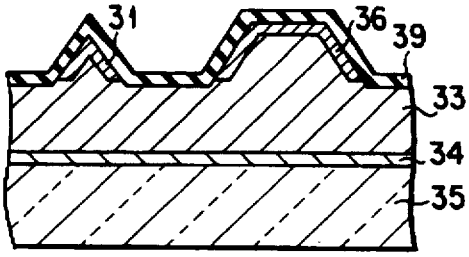

Thereafter, the Al layer 45 on the rear surface of the glass substrate 35 is removed by a mixed acid solution of $NHO_3$, $CH_3COOH$, and HF. Only the Si substrate 41 is then etched away by an aqueous solution mixture of ethylene, pyrocatechol, and pyrazine (ethylenediamine:pyrocatechol:pyrazine:water=75 cc:12 g:3 mg:10 cc). Consequently, as illustrated in FIG. 16, the insulating layer 39 is exposed and projecting portions corresponding to the emitter layer 31 and the focusing electrode layer 36 covered with the insulating layer 39 are exposed.

Figure 17:
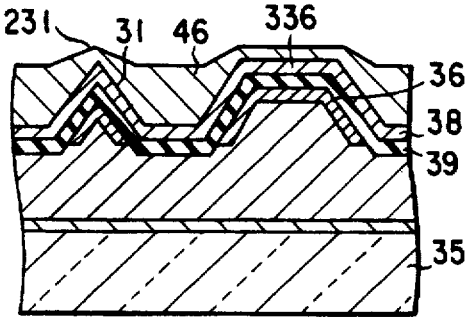

A W layer, for example, is formed as a gate electrode layer 38 on the insulating layer 39 along the shapes of the projecting portions 31 and 36 covered with the insulating layer 39. More specifically, the gate electrode layer 38 is formed to have a film thickness of 0.3 μm by, e.g., sputtering. In FIG. 17, a photoresist layer 46 is so formed as to slightly cover distal ends 231 and 336 of the projecting portions covered with the gate electrode layer 38 and the insulating layer 39. This photoresist layer 46 is formed to have a thickness of 0.9 μm by, e.g., spin coating.

Figure 18:
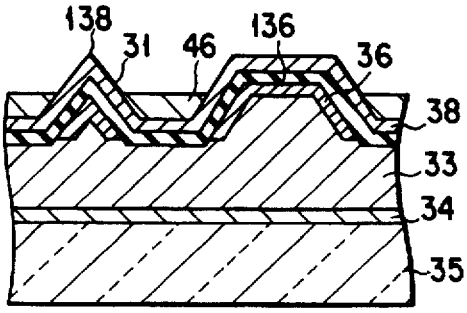

In FIG. 18, the resist 46 is etched away by using oxygen plasma so that a distal end 138 (including the distal end of the insulating layer) of the gate electrode 38 formed along the emitter 31 appears to a certain extent, e.g., 0.7 μm. At the same time, the resist on a summit 136 of the focusing electrode 36 is also removed.

Figure 19:
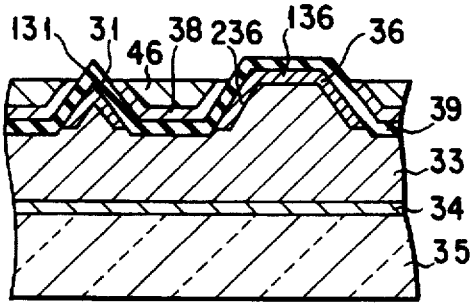

In FIG. 19, the gate electrode layer on a distal end 131 of the emitter 31 is removed by, e.g., reactive ion etching to form a hole in a portion of the gate electrode 38 corresponding to the distal end 131 of the emitter 31. In this step, the gate electrode layer on the summit 136 of the focusing electrode 36 is simultaneously etched away to form a hole.

Figure 20:
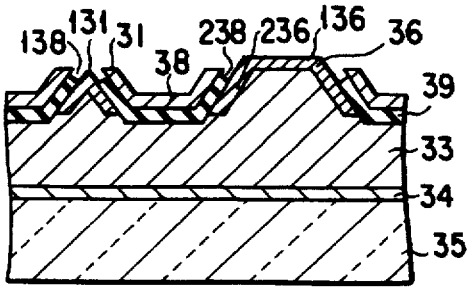

In FIG. 20, the resist 46 is removed, and the insulating layer around the distal end 131 of the emitter 31 and on the summit 136 of the focusing electrode 36 is selectively etched away by using an $NH_4F{\cdot}HF$ solution mixture. Consequently, the distal end 131 of the emitter 31 and the summit 136 of the focusing electrode 36 are exposed. The result is that the quadrangular pyramid emitter 31 and the focusing electrode 36 surrounding the emitter 31 and having a side surface 236 are completed.

The characteristic feature of this field-emission cold-cathode device fabrication method is that the patterning of the focusing electrode is performed simultaneously with the patterning for forming the emitter formation mold, and so the emitter and the focusing electrode can be integrally formed by flowing the resultant structure through regular fabrication steps. Consequently, compared to conventional field-emission cold-cathode device fabrication methods, the number of fabrication steps can be greatly decreased in that patterning step or sputtering for forming the focusing electrode is not required.

Figure 21:
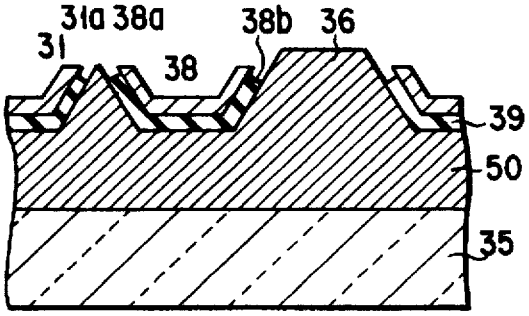
FIG. 21 is a sectional view of the second example of the field-emission cold-cathode device according to the first preferred embodiment of the first aspect.

FIG. 21 is a sectional view showing the second example of the field-emission cold-cathode device according to the first preferred embodiment of the first aspect. In the second example, a mold for forming an emitter and a focusing electrode layer is entirely buried with a metal layer 50, instead of separately burying the emitter and the focusing electrode layer with a resistance layer. This field-emission cold-cathode device can be fabricated in the same manner as in the first example except that the emitter and the focusing electrode layer are thus formed. That is, so long as the material of the metal layer 50 is properly selected, no new metal layer need be formed for connection, and this further decreases the number of steps than in the first example.

Figure 22:
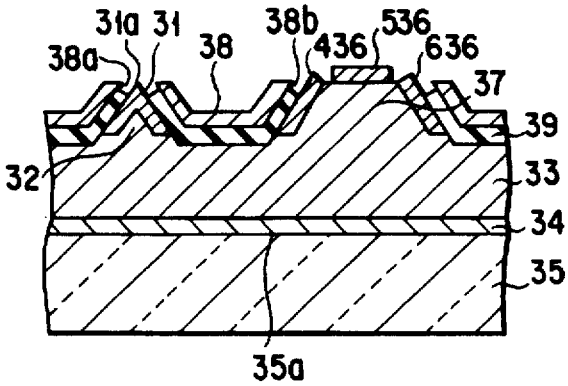
FIG. 22 is a sectional view of the third example of the field-emission cold-cathode device according to the first preferred embodiment of the first aspect.

FIG. 22 is a sectional view of the third example of the field-emission cold-cathode device according to the first preferred embodiment of the first aspect. The field-emission cold-cathode device according to the third example has the same structure as the field-emission cold-cathode device shown in FIG. 20 except that a focusing electrode 36 is separated into inclined surfaces 436 and 636 and a flat portion 536. In this structure, an emitter 31, the summit 536, and the side portions 436 and 636 can be set at different potentials. For example, the focusing electrode thus separated can be formed as follows. A field-emission cold-cathode device similar to a first example shown in FIG. 20 is prepared. A resist is coated on the surface of the device to form a resist layer. Patterning is performed by exposure and development to remove the angular portions of the resist respectively. Then the device is subjected to etch the angular portions of the focusing electrode to separate the side portion 436 and 636 and the flat portion 536.

Figure 23:
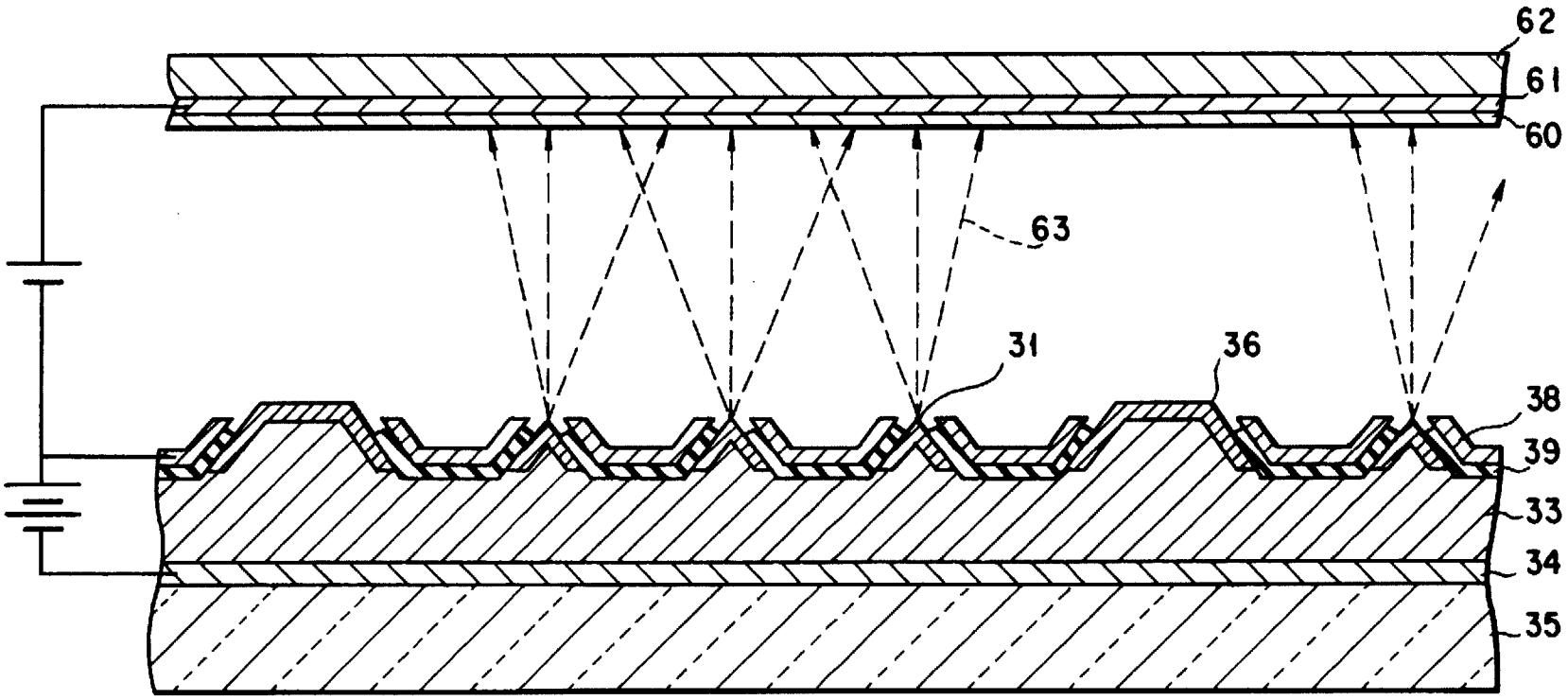
FIG. 23 is a schematic view showing the sectional structure of a flat image display apparatus using the field-emission cold-cathode device of the present invention.

FIG. 23 is a schematic view showing the sectional structure of a flat image display apparatus using the field-emission cold-cathode device of the present invention. In this flat image display apparatus, a glass faceplate 62 on which a phosphor layer 60 and an anode electrode layer 61 are formed is so arranged as to oppose the emitters 31 shown in FIGS. 8 and 9. The phosphor layer 60 is made to emit light by electron beams 63 emitted from these emitters 31 toward the anode electrode layer 61, thereby displaying a desired image. As described previously, the action of a focusing electrode 36 enhances the effect of focusing the electron beams 63 from the emitters 31, and none of the electron beams 63 is captured by the focusing electrode 36. Consequently, high-quality images can be displayed.

Figure 24:
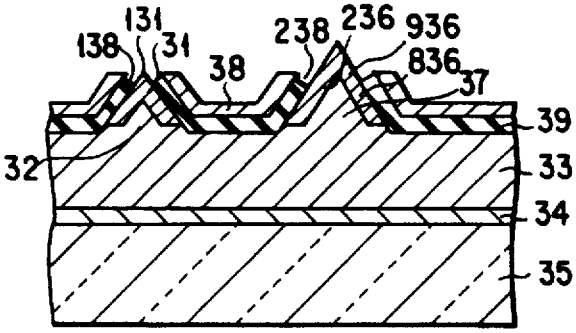
FIG. 24 is a sectional view of the fourth example of the field-emission cold-cathode device according to the first preferred embodiment of the first aspect.
Figure 25:
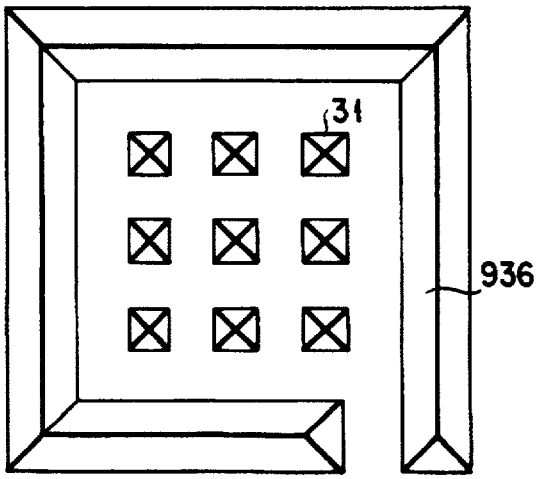
FIG. 25 is a plan view of the field-emission cold-cathode device including the structure shown in FIG. 24.

FIG. 24 is a sectional view showing the fourth example of the field-emission cold-cathode device according to the first preferred embodiment of the first aspect. FIG. 25 is a plan view of the field-emission cold-cathode device including the structure shown in FIG. 24.

As in FIG. 24, the field-emission cold-cathode device according to the fourth example has the same structure as the field-emission cold-cathode device shown in FIG. 20 except that a focusing electrode 936 consists of an inclined surface 236 and another inclined surface 836 formed on a side away from the inclined surface 236. Even in this structure, the effect of controlling the spread of electron beams from an emitter 31 can be obtained, as in the field-emission cold-cathode device shown in FIG. 20.

Figure 26:
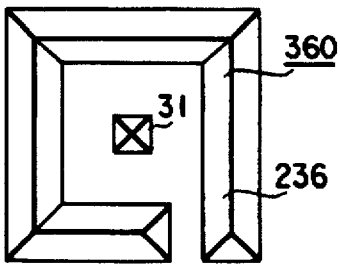
FIG. 26 is a plan view of the fifth example of the field-emission cold-cathode device according to the first preferred embodiment of the first aspect.

FIG. 26 is a plan view showing the fifth example of the field-emission cold-cathode device according to the first preferred embodiment of the first aspect. In each of the first to fourth examples, the focusing electrode 36 is formed around the region consisting of a plurality of emitters. This fifth example differs from the first to fourth examples in that a focusing electrode 360 is formed for one emitter 31. Even a structure like this is incorporated in the scope of the present invention. Since an inclined surface 236 is formed on the focusing electrode 360, the effect of controlling the spread of electron beams from the emitter 31 can be obtained as in the first to fourth examples.

The first example of a field-emission cold-cathode device according to the second preferred embodiment of the first aspect will be described below.

Figure 27:
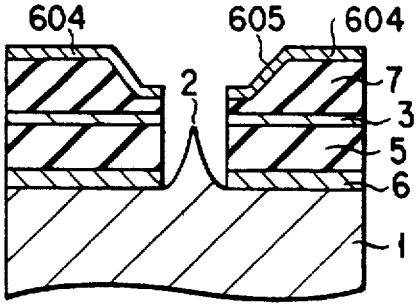
FIG. 27 is a schematic sectional view showing the first example of a field-emission cold-cathode device according to the second preferred embodiment of the first aspect.

FIG. 27 is a schematic sectional view showing the first example of the field-emission cold-cathode device according to the second preferred embodiment. As shown in FIG. 27, in this first example of the field-emission cold-cathode device according to the second preferred embodiment, an emitter 2 having a sharp distal end is formed on a substrate made from, e.g., Si. An oxide film 6, an insulating layer 5, and a gate electrode 3 are formed in this order so as to form a hole only in a portion above the emitter 2. An insulating layer 7 and a focusing electrode 604 are formed on the gate electrode 3 such that a hole is formed only in a portion above the emitter 2. The insulating layer 7 has an inclined surface on a side near the emitter. The focusing electrode 604 is formed along the surface shape of the insulating layer 7.

In this field-emission cold-cathode device, an inclined surface 605 is formed in a region of an end portion, near the emitter, of the focusing electrode 604. Accordingly, the spread of electron beams emitted from the emitter 2 can be efficiently controlled.

For example, the above field-emission cold-cathode device can be fabricated as follows.

The emitter can be formed in the same manner as in the conventional method as illustrated in FIGS. 1 to 4. After the emitter is formed, the insulating film 5 such as an $SiO_2$ film and the gate electrode layer 3 are formed. On the gate electrode layer 3, an insulating layer 7 and a focusing electrode 604 are formed in order. Consequently, the field-emission cold-cathode device shown in FIG. 27 is obtained. In the device, a thickness of the portion of the inclined surface 605 of the insulating film 5 can be set more thinner than that of the other portion of the film 5.

Figure 28:
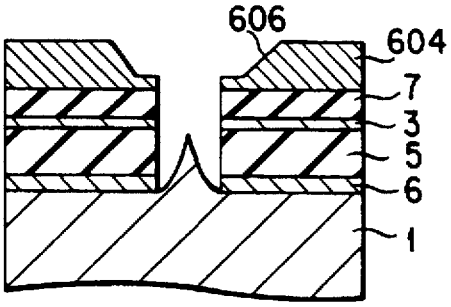
FIG. 28 is a schematic sectional view showing the second example of the field-emission cold-cathode device according to the second preferred embodiment of the first aspect.

FIG. 28 is a schematic sectional view showing the second example of the field-emission cold-cathode device according to the second preferred embodiment. In this field-emission cold-cathode device, an emitter 2, an insulating film 5, and a gate electrode layer 3 are almost identical with those of the field-emission cold-cathode device shown in FIG. 27. This field-emission cold-cathode device differs from the field-emission cold-cathode device illustrated in FIG. 27 in that an insulating layer 7 is flat and a focusing electrode layer 604 itself has an inclined surface 606 in a region of its end portion.

An example of a field-emission cold-cathode device according to the third preferred embodiment of the first aspect will be described below.

Figure 29:
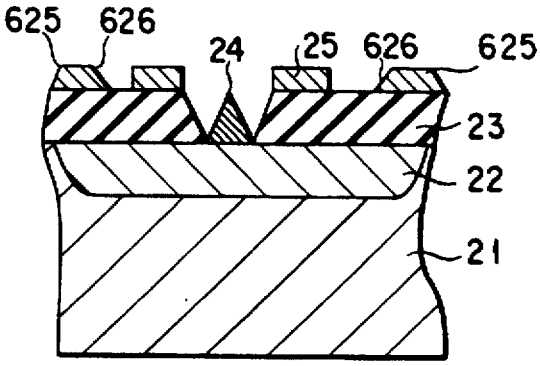
FIG. 29 is a schematic sectional view showing one example of a field-emission cold-cathode device according to the third preferred embodiment of the first aspect.

FIG. 29 is a schematic sectional view showing this example of the field-emission cold-cathode device according to the third preferred embodiment.

In this field-emission cold-cathode device according to the third preferred embodiment, as illustrated in FIG. 29, an emitter 24 having a sharp distal end is formed on a p-type substrate 21 on the surface of which an n-type region 22 is formed. On this p-type substrate 21 on which the n-type region 22 is formed, an insulating layer 23 is also formed such that a hole is formed above the emitter 24. On the insulating layer 23, a gate electrode 25 is formed near the edge of the hole above the emitter. A focusing electrode layer 625 is formed in a portion farther from the distal end of the emitter than the gate electrode layer. This focusing electrode layer 625 has an inclined surface 626 in a region of an end portion close to the emitter 24.

In this field-emission cold-cathode device, the inclined surface 626 is formed on the focusing electrode layer 625. Accordingly, the spread of electron beams emitted from the emitter 24 can be effectively controlled.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A field-emission cold-cathode device comprising:

a substrate;

an emitter formed on said substrate and having sharp distal end;

a gate electrode electrically insulated from said emitter and having a gate electrode hole in a region of the sharp distal end of said emitter; and a focusing electrode electrically insulated from said gate electrode, said focusing electrode being formed further from the sharp distal end of said emitter then said gate electrode and having a first inclined surface in a region of an end portion near said emitter and a second inclined surface opposing the first inclined surface so as to form a triangular section.

2. A device according to claim 1, wherein the first and second inclined surfaces are separated.

3. A device according to claim 1, wherein said focusing electrode is made from the same material as said emitter.

4. A device according to claim 1, further comprising an insulating layer formed on said substrate and having a hole at least above the region of the sharp distal end of said emitter, and wherein said gate electrode is formed on said insulating layer with said gate electrode hole at least above the region of the sharp distal end of said emitter, and wherein a peripheral portion of the gate electrode hole is slightly extended on a side closer to said emitter than an edge of the hole in said insulating layer.

5. A device according to claim 1, further comprising:

a first insulating layer formed on said substrate and having a hole above said emitter, said gate electrode being formed on said first insulating layer and having a hole above said emitter; and a second insulating layer formed on said gate electrode and having a hole above said emitter, said focusing electrode being formed on said second insulating layer and having a hole above said emitter.

6. A device according to claim 5, wherein said second insulating layer has an inclined surface on at least a side near said emitter, and said focusing electrode is formed along a shape of a surface of said second insulating layer.

7. A device according to claim 1, wherein an insulating layer having a hole above said emitter is farther formed on the surface of said substrate, said gate electrode layer is formed near the hole on said insulating layer, and said focusing electrode layer is formed on said insulating layer farther from the distal end of said emitter than said gate electrode layer.

8. A device according to claim 7, wherein said substrate comprises a p-type substrate on a surface of which an n-type region is formed, said emitter is formed on said n-type region.

9. A field-emission cold-cathode device comprising:

a substrate;

an emitter formed on said substrate and having sharp distal end;

a gate electrode electrically insulated from said emitter and having a gate electrode hole in a region of the sharp distal end of said emitter; and a focusing electrode electrically insulated from said gate electrode, said focusing electrode being formed further from the sharp distal end of said emitter then said gate electrode and having a first inclined surface in a region of an end portion near said emitter and a second inclined surface opposing the first inclined surface with a flat portion between the first and second inclined surfaces so as to form a trapezoidal section.

10. A device according to claim 9, wherein the first and second inclined surfaces and the flat portion are separated.

11. A field-emission cold-cathode device comprising:

a substrate;

a metal layer formed on said substrate;

an emitter formed on a surface of said metal layer and having a sharp distal end;

a gate electrode electrically insulated from said emitter and having a gate electrode hole in a region of the sharp distal end of said emitter; and a focusing electrode electrically insulated from said gate electrode, said focusing electrode being formed integrally with said emitter on a surface of said metal layer further from the sharp distal end of said emitter than said gate electrode and having a first inclined surface in a region of an end portion near said emitter and a second inclined surface opposing the first inclined surface so as to form a triangular section.

12. A field-emission cold-cathode device comprising:

a substrate;

an emitter formed on said substrate having a sharply pointed distal end;

a gate electrode electrically insulated from said emitter and having a gate electrode hole in a region of the sharply pointed distal end of said emitter;

a focusing electrode electrically insulated from said gate electrode, said focusing electrode being formed so as to surround said emitter and to be farther from the sharply pointed distal end of said emitter than said gate electrode and having an inclined surface in a region of an end portion facing said emitter.

13. A device according to claim 12, wherein a plurality of said emitters are formed on said substrate, all of said emitters being surrounded by said focusing electrode.

14. A device according to claim 12, wherein said focusing electrode has a second inclined surface opposing the first inclined surface so as to form a triangular section.

15. A device according to claim 14, wherein the first and second inclined surfaces are separated.

16. A device according to claim 12, wherein said focusing electrode has a second inclined surface opposing the first inclined surface and a flat portion between the first and second inclined surfaces so as to form a trapezoidal section.

17. A device according to claim 16, wherein the first and second inclined surfaces and the flat portion are separated.

18. A device according to claim 12, wherein said focusing electrode is made from the same material as said emitter.

19. A device according to claim 12, further comprising an insulating layer formed on said substrate and having a hole at least above the region of the sharply pointed distal end of said emitter, and wherein said gate electrode is formed on said insulating layer with said gate electrode hole being at least above the region of the sharply pointed distal end of said emitter, and wherein a peripheral portion of the gate electrode hole is slightly extended on a side closer to said emitter than an edge of the hole in said insulating layer.

20. A device according to claim 12, further comprising:

a first insulating layer formed on said substrate, said first insulating layer having a first insulating layer hole above said emitter with said gate electrode being formed on said first insulating layer with said gate electrode hole aligned with the first insulating layer hole;

a second insulating layer having an inclined surface on at least a side of the second insulating layer which is nearest to said emitter, said second insulating layer being formed on said gate electrode and having a second insulating layer hole above said emitter and aligned with said gate electrode hole, wherein said focusing electrode is formed on at last the inclined surface of said second insulating layer, said focusing electrode having a focusing electrode hole above said emitter aligned with said second insulating layer hole.

21. A device according to claim 12, wherein an insulating layer having a hole above said emitter is farther formed on the surface of said substrate, said substrate comprising a p-type substrate on a surface of which an n-type region is formed with said emitter being formed on said n-type region, said gate electrode being formed near the hole on said insulating layer, and said focusing electrode being formed on said insulating layer farther from the sharply pointed distal end of said emitter than said gate electrode.

22. A field-emission cold-cathode device comprising:

a substrate;

a metal layer formed on said substrate;

an emitter formed on a surface of said metal layer and having a sharp distal end;

a gate electrode electrically insulated from said emitter and having a gate electrode hole in a region of the sharp distal end of said emitter; and a focusing electrode electrically insulated from said gate electrode, said focusing electrode being formed integrally with said emitter on a surface of said metal layer further from the sharp distal end of said emitter than said gate electrode and having a first inclined surface in a region of an end portion near said emitter.

* * * * *